US007871303B2

(12) United States Patent
Cole

(10) Patent No.: US 7,871,303 B2
(45) Date of Patent: Jan. 18, 2011

(54) SYSTEM FOR FILLING AND VENTING OF RUN-IN GAS INTO VACUUM TUBES

(75) Inventor: Barrett E. Cole, Bloomington, MN (US)

(73) Assignee: Honeywell International Inc., Morristown, NJ (US)

( * ) Notice: Subject to any disclaimer, the term of this patent is extended or adjusted under 35 U.S.C. 154(b) by 638 days.

(21) Appl. No.: 11/897,407

(22) Filed: Aug. 30, 2007

(65) Prior Publication Data

US 2008/0242179 A1 Oct. 2, 2008

Related U.S. Application Data

(60) Provisional application No. 60/905,958, filed on Mar. 9, 2007.

(51) Int. Cl.
*H01J 9/00* (2006.01)
*H01J 9/38* (2006.01)

(52) U.S. Cl. ..... 445/53; 445/38; 445/70; 445/73; 445/6; 141/4; 141/7; 141/65; 141/66

(58) Field of Classification Search ..... 445/38, 445/53, 56, 70, 73, 6; 141/4, 7, 65, 66
See application file for complete search history.

(56) References Cited

U.S. PATENT DOCUMENTS 1,851,360 A * 3/1932 Jacobsen ..... 445/56
3,294,468 A * 12/1966 Emidy et al. ..... 445/56
4,578,043 A * 3/1986 Teshima et al. ..... 445/40
5,371,435 A 12/1994 Ohishi et al.
5,898,377 A 4/1999 Adachi
5,959,301 A 9/1999 Warashina
6,780,378 B2 8/2004 Abbasi et al.
6,784,430 B2 8/2004 Matocha et al.
7,202,794 B2 4/2007 Huseynov et al.
7,244,946 B2 7/2007 Burnette et al.
7,432,509 B2 10/2008 Mori et al.
7,456,412 B2 11/2008 Cole et al.
2002/0130951 A1 9/2002 Kurono
2006/0169908 A1 8/2006 Mori et al.
2007/0132050 A1 6/2007 Sumiya et al.

* cited by examiner

*Primary Examiner*—Mariceli Santiago
(74) *Attorney, Agent, or Firm*—Luis M. Ortiz; Kermit D. Lopez; Kris T. Fredrick

(57) ABSTRACT

Heavier noble gases such as xenon and argon can reduce the run-in period for vacuum tubes and in particular flame detector tubes. The tubes can be filled with a run-in gas and then run-in. The run-in gas can then be exchanged for an end gas, such as neon, and the tube sealed. A final conditioning step of running in the tube with the end gas can further smooth the tube's anode and cathode to thereby improve performance and operating life.

5 Claims, 3 Drawing Sheets

SYSTEM FOR FILLING AND VENTING OF RUN-IN GAS INTO VACUUM TUBES

CROSS REFERENCE TO RELATED APPLICATIONS

This patent application claims the priority and benefit of U.S. Provisional Patent Application No. 60/905,958 filed on Mar. 9, 2007 entitled "Improved Tube Run-In" and which is incorporated herein by reference in its entirety.

TECHNICAL FIELD

Embodiments relate to the manufacture of flame detector tubes and vacuum tubes. Embodiments also relate to sputtering, gettering, vacuum chambers, manifolds, and process gas delivery systems.

BACKGROUND OF THE INVENTION

Vacuum tubes, the predecessors of transistors and diodes, are air tight chambers with cathodes and anodes. The air is largely evacuated from the tube, hence the name vacuum tube. The tube's cathode is held at a lower voltage than the tube's anode so that electrons are accelerated from the cathode to the anode. As electrons move to the anode, they collide with air molecules knocking even more electrons loose and thereby amplifying the number of electrons. In many tubes, the cathode is heated to produce thermionic electrons. In other tubes, photons are allowed to impact the cathode to cause the release of photoelectrons.

Vacuum tubes are rarely used in circuitry any more. They are, however, often used in light detection. Some tubes are so sensitive that a single photon can cause an electron to leave the cathode and induce a large avalanche of secondary and tertiary electrons that reach the anode. One type of photon sensitive tube is a flame detector tube. A flame detector tube is sensitive to the photons produced by flames.

In operation, a tube's anode and cathode are subjected to a constant and necessary bombardment of electrons and ions. The result is the etching and sputtering of the cathode and anode. To provide long tube life, the anode and cathode are often made from or coated with resistant materials such as tungsten and molybdenum. Similarly, the small amount of gas in the tube is chosen to be one that will not damage the anodes and cathodes too much nor react with other tube materials. Neon and a neon/hydrogen mix are often used as tube gasses because they are fairly light and nonreactive.

In the manufacture of vacuum tubes, a run-in period is often required. When first produced, anodes and cathodes are rough. The rough surfaces affect the electric fields and result in inconsistent and occasionally even damaging electron flows and sputtering effects. Run-in is a process in which the tube is run at an elevated voltage to sputter the surfaces smooth. The materials and gases used in vacuum tubes, however, are specifically chosen to minimize sputtering. Engineering decisions for extended tube life also cause long run-in times. Systems and methods for quicker run-in are needed.

BRIEF SUMMARY

The following summary is provided to facilitate an understanding of some of the innovative features unique to the embodiments and is not intended to be a full description. A full appreciation of the various aspects of the embodiments can be gained by taking the entire specification, claims, drawings, and abstract as a whole.

It is therefore an aspect of the embodiments that to obtain an unsealed tube that has at least one anode and at least one cathode. Some tubes are unsealed because they have an open end, others are unsealed because they have open fill tubes that pass through the base of the tube.

It is another aspect of the embodiments to fill the tube with a run-in gas. A run-in gas is a gas that exhibits superior sputtering properties without also reacting with the cathode, anode, or tube material. Noble gases, such as xenon and argon, are good run-in gasses. The tube is run-in while filled with the run-in gas.

It is a further aspect of the embodiments that after running in the tube, it is filled with an end gas. The end gas is the gas that will remain in the tube when it is in operation. As such, the end gas can be neon or neon/hydrogen. The tube is sealed while filled with the end gas.

BRIEF DESCRIPTION OF THE DRAWINGS

The accompanying figures, in which like reference numerals refer to identical or functionally similar elements throughout the separate views and which are incorporated in and form a part of the specification, further illustrate aspects of the embodiments and, together with the background, brief summary, and detailed description serve to explain the principles of the embodiments.

DETAILED DESCRIPTION

The particular values and configurations discussed in these non-limiting examples can be varied and are cited merely to illustrate at least one embodiment and are not intended to limit the scope thereof. In general, the figures are not to scale.

Heavier noble gases such as xenon and argon can reduce the run-in period for vacuum tubes and in particular flame detector tubes. The tubes can be filled with a run-in gas and then run-in. The run-in gas can then be exchanged for an end gas, such as neon, and the tube sealed. A final conditioning step of running in the tube with the end gas can further smooth the tube's anode and cathode to thereby improve performance and operating life.

Figure 1:
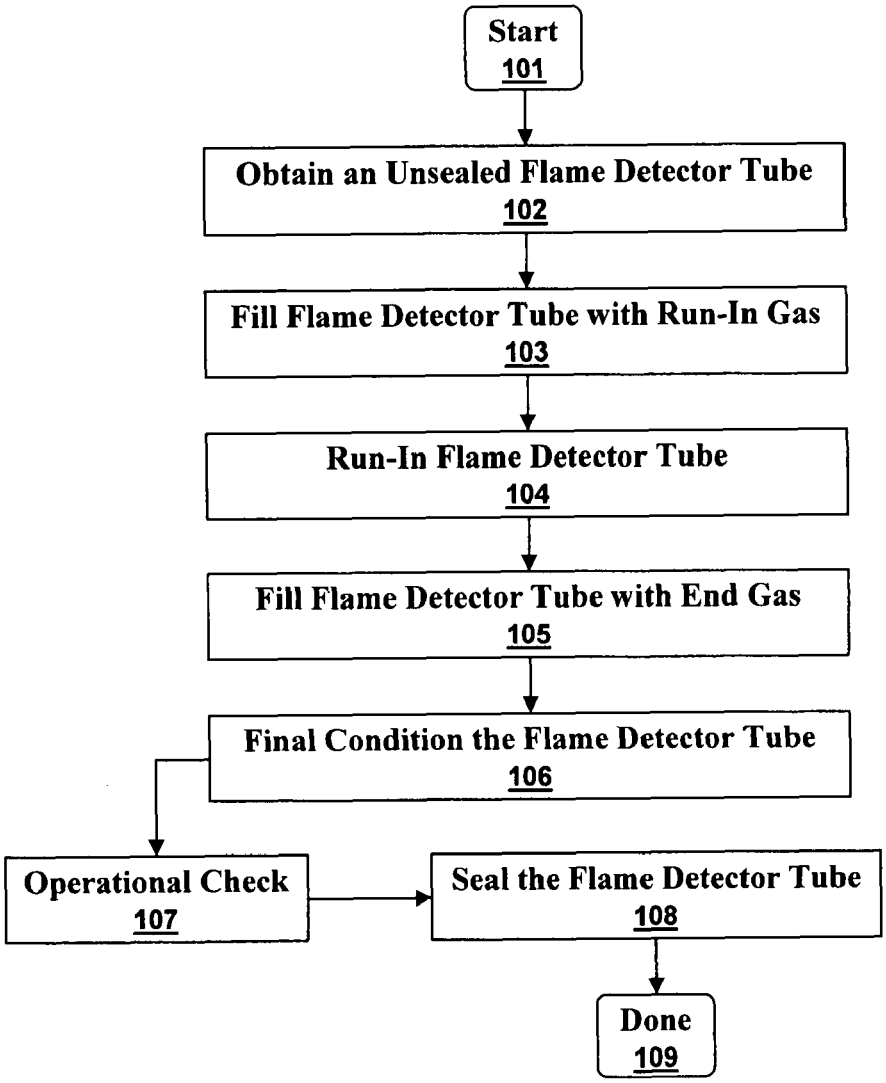
FIG. 1 illustrates a high level flow diagram of an improved run-in process in accordance with aspects of the embodiments.

FIG. 1 illustrates a high level flow diagram of an improved run-in process in accordance with aspects of the embodiments. After the start 101, an unsealed flame detector tube is obtained 102 and then filled with a run-in gas 103. The tube is then run-in 104 by creating a large voltage difference between the anode and the cathode. The flame detector tube is then filled with end gas 105 and subjected to final conditioning 106. After an operational check, the flame detector tube can be sealed 108 and the process is done 1098.

The operational check 107 and the final conditioning 106 can both be performed after sealing the tube when certain conditions are met. One of those conditions is that the gas mixture and pressure are exactly the same. The final conditioning voltage, however, can differ from the operational voltage. Similarly, run-in 104 and final conditioning 106 can use the same gas mixture but at a different pressure or at a different voltage. For example, the tube can be filled with a low pressure Xenon/Hydrogen mix and run-in at a high voltage. Afterward, additional Xenon and Hydrogen can be added to increase the gas pressure inside the tube. The tube can be sealed and then a lower voltage can then be used for final conditioning. The operational check can then involve checking tube operation at its operation voltage.

The final conditioning step 106 is essentially the same as the method currently used to run-in the tube because current technology uses the end gas for run-in but does not use a run-in gas. The run-in step 104 is approximately five times faster than the final conditioning step 106. For example, under current technology, a run-in process can take six days. In the improved run-in process, filling the tube with run-in gas followed by a day of run-in replaces approximately five days of the current technology process. As such, a tube can be completely run-in including a final conditioning step, in two days instead of six days. Those practiced in the art of vacuum tube manufacture are familiar with filling tubes with gas and running them in.

Figure 2:
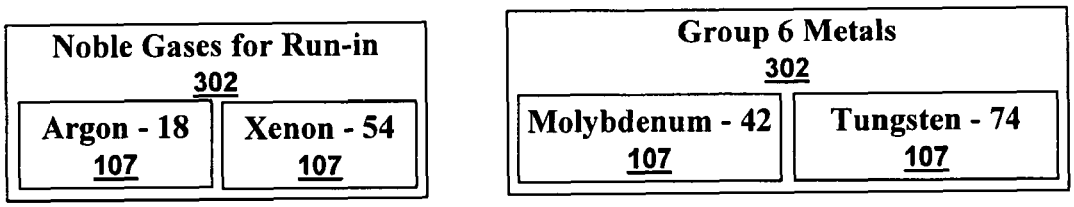
FIG. 2 illustrates a gases and materials for an improved run-in process in accordance with aspects of the embodiments.

FIG. 2 illustrates a gases and materials for an improved run-in process in accordance with aspects of the embodiments. Argon and xenon are good run in gases because they are noble gases and fairly heavy. Xenon, with atomic number 54, is three times heavier than argon with atomic number 18 and also produces double ions. The group 6 metals molybdenum and tungsten are somewhat resistant to sputtering in vacuum tubes. Molybdenum has atomic number 42, whereas tungsten has atomic number 74.

Figure 3:
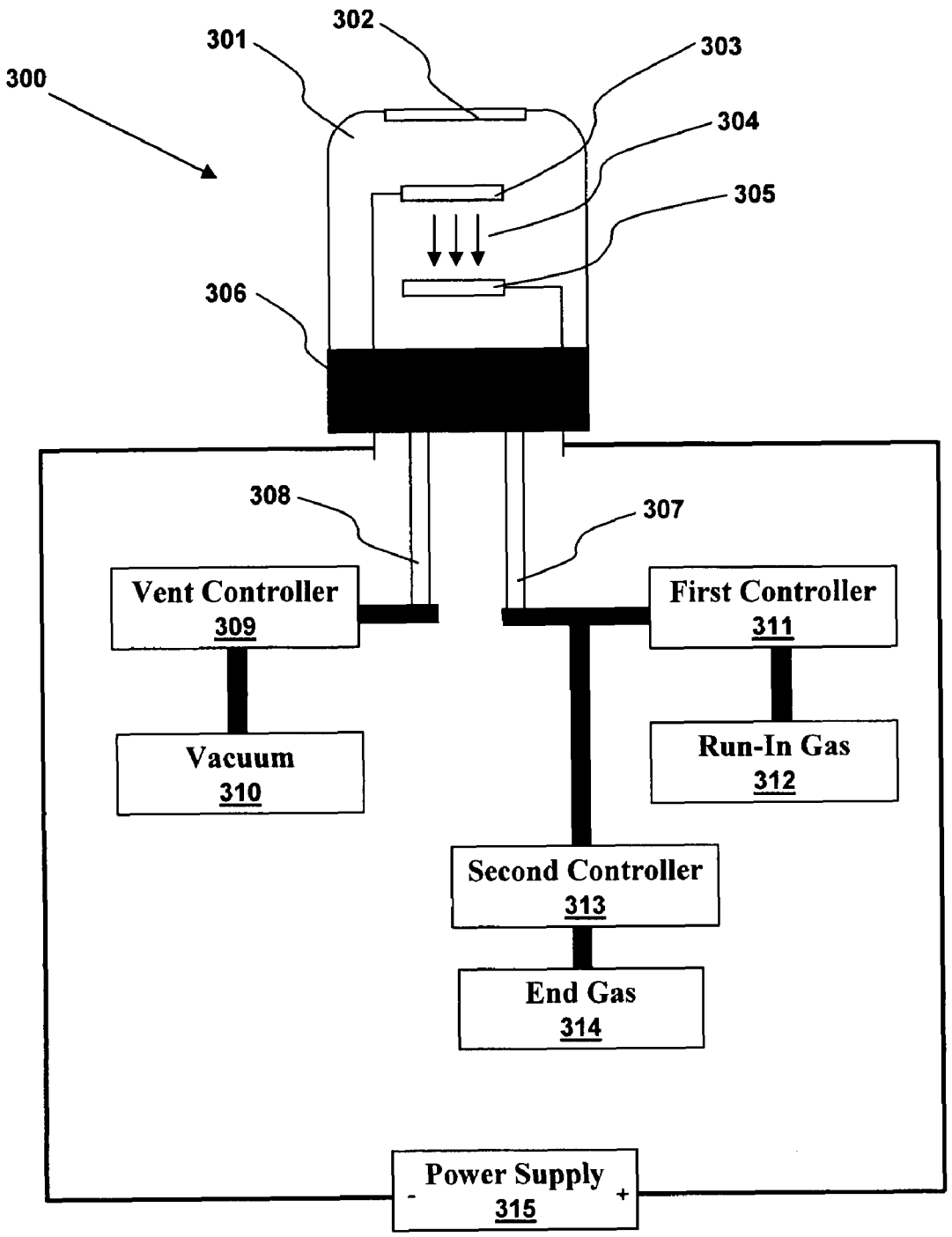
FIG. 3 illustrates a high level block diagram of a manifold system for an improved run-in process in accordance with aspects of the embodiments.

FIG. 3 illustrates a high level block diagram of a manifold system for an improved run-in process in accordance with aspects of the embodiments. A flame detector tube 300 has an air tight envelope 301 and a window 302. The window 302 is transparent to the photons typically produced by flames. The photons pass through the window 302 and strike the cathode 303 to produce photoelectrons 304. The photoelectrons 304 are accelerated to the anode 305 by a voltage difference provided by a power supply 315. A large enough voltage difference can cause electrons to spontaneously leave the cathode in the absence of photons. It is in that voltage realm that the run-in process is typically run.

A first controller 311 controls the flow of run-in gas 312 into a fill tube 307 and from there into the flame detector tube 300. Similarly, a second controller 313 controls the flow of an end gas 314 into the flame resistant tube 300. A vent controller 309 connected to a vent tube 308 can vent the flame detector tube to vacuum 310. The vent tube 308 can be removed from the system if the vent controller 309 is connected to the fill tube 307.

The flame detector tube 300 can be sealed by crushing or pinching off the fill tube 307 and the vent tube 308. The sealing operation can also cut the fill end vent tubes below the seal so the flame detector tube 300 can be removed. Current technology provides for connecting unsealed tubes to the controllers, sealing tubes after run-in, and removing sealed tubes.

Figure 4:
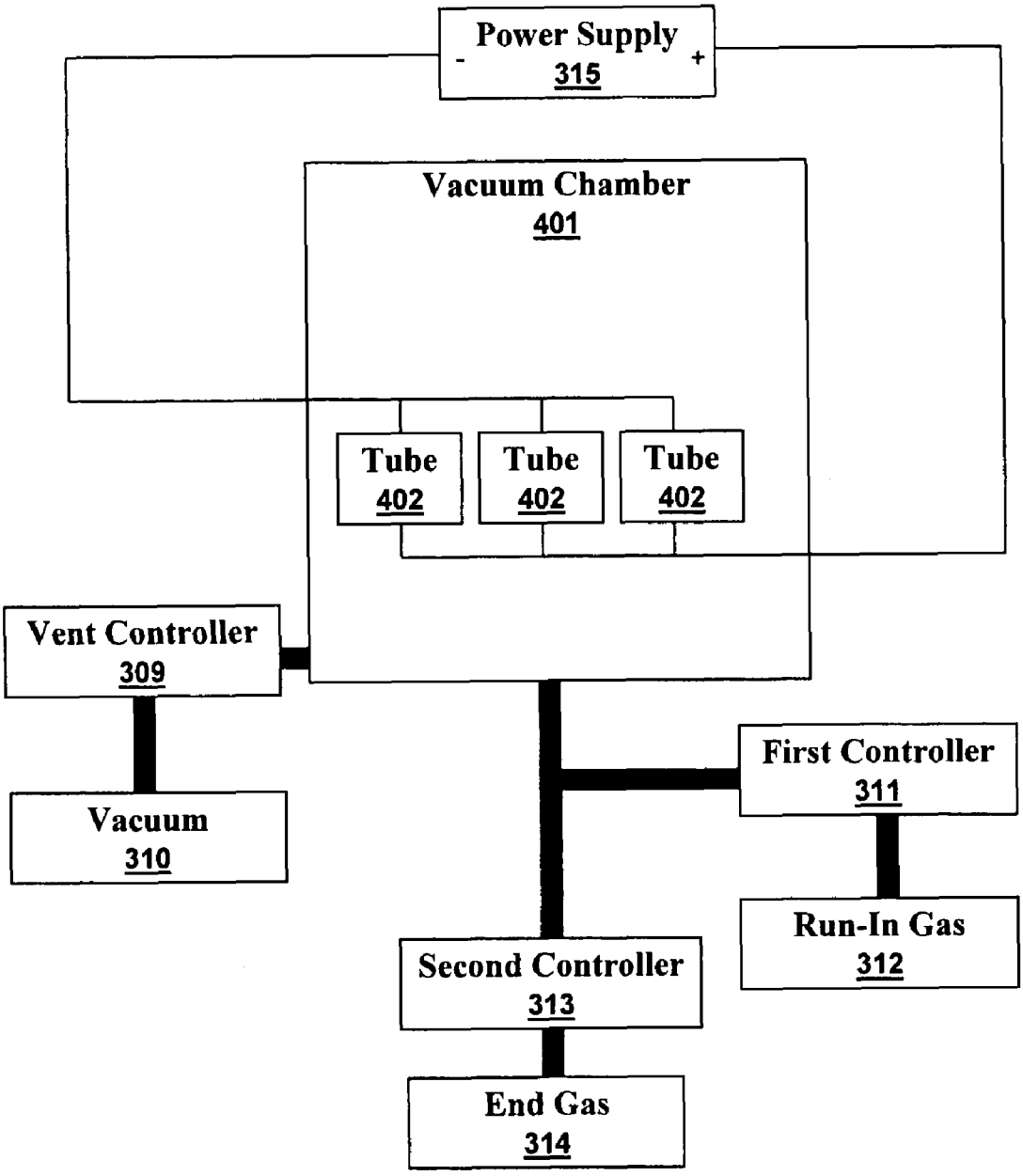
FIG. 4 illustrates a high level block diagram of a chamber system for an improved run-in process in accordance with aspects of the embodiments.

FIG. 4 illustrates a high level block diagram of a chamber system for an improved run-in process in accordance with aspects of the embodiments. Flame detector tubes 402 can be placed in a vacuum chamber 401 that is then sealed. The run-in gas and end gas can be introduced into the vacuum chamber using the same techniques as those in FIG. 3, although on a much larger scale. Filling and venting the vacuum chamber 401 also fills and vents the tubes 402. The power supply 315 can be used to run-in the tubes 402. The tubes 402 are sealed before the vacuum chamber 401 is opened and the tubes 402 removed.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The embodiments of the invention in which an exclusive property or right is claimed are defined as follows. Having thus described the invention what is claimed is:

1. A system comprising:

a first gas controller that controls the flow of a run-in gas into a tube;

a second gas controller that controls the flow of an end gas into the tube;

a venting controller that controls venting the tube;

a power supply that applies a voltage between an anode and a cathode wherein the tube comprises the anode and the cathode and wherein said voltage comprises a particular voltage that causes electrons to spontaneously leave said cathode;

walls of said tube comprising a gap that encloses a window that permits a view into said tube wherein said window is transparent to photons produced by flames; and a means for sealing the tube.

2. The system of claim 1 further comprising:

a manifold;

wherein the tube further comprises a fill tube;

wherein connecting the fill tube to the manifold provides a gas connection for filling the tube;

wherein blocking the fill tube seals the tube.

3. The system of claim 1 further comprising:

a vacuum chamber wherein the tube is placed inside the chamber;

wherein the first gas controller controls the flow of the run-in gas into the chamber and thereby into the tube;

wherein the second gas controller controls the flow of the end gas into the chamber and thereby into the tube; and wherein the venting controller chamber venting and thereby controls tube venting.

4. The system of claim 1 wherein the run-in gas comprises a noble gas of atomic weight 18 or more.

5. The system of claim 1 wherein the cathode or the anode comprise a group 6 metal.

* * * * *